US005251586A

United States Patent [19]

Koga et al.

[11] Patent Number: 5,251,586

[45] Date of Patent: Oct. 12, 1993

[54] VALVE MECHANISM FOR AN INTERNAL COMBUSTION ENGINE

[75] Inventors: Kazuhiro Koga, Tokyo; Takashi Yamamoto, Hiroshima; Shinji Kamimaru; Kenzo Watanabe, both of Tokyo, all of Japan

[73] Assignee: Fuji Jukogyo Kabushiki Kaisha, Tokyo, Japan

[21] Appl. No.: 858,674

[22] Filed: Mar. 27, 1992

[30] Foreign Application Priority Data

Mar. 29, 1991 [JP] Japan ..... 3-28604[U]
Mar. 29, 1991 [JP] Japan ..... 3-28613[U]

[51] Int. Cl.[5] ..... F01L 1/34
[52] U.S. Cl. ..... 123/90.16; 123/90.44
[58] Field of Search ..... 123/90.15, 90.16, 90.22, 123/90.45, 90.46, 90.55, 90.27, 90.39, 90.4, 90.41, 90.44

[56] References Cited

U.S. PATENT DOCUMENTS

| | | | |
|---|---|---|---|
| 4,373,477 | 2/1983 | Buente et al. | 123/90.46 |
| 4,800,851 | 1/1989 | Hertrich et al. | 123/90.46 |
| 4,854,273 | 8/1989 | Uesugi et al. | 123/90.46 |
| 4,926,804 | 5/1990 | Fukuo | 123/90.16 |
| 5,020,488 | 6/1991 | Watanabe | 123/90.16 |
| 5,033,420 | 7/1991 | Matayoshi et al. | 123/90.16 |
| 5,046,462 | 9/1991 | Matayoshi et al. | 123/90.16 |

*Primary Examiner*—Willis R. Wolfe
*Assistant Examiner*—Weilun Lo
*Attorney, Agent, or Firm*—Martin A. Farber

[57] ABSTRACT

A valve mechanism has a low-speed cam and a high-speed cam, a low-speed rocker arm operatively connected with a valve and a high-speed rocker arm. A changeover pin is provided for connecting the low-speed rocker arm and the high-speed rocker arm to each other so as to be rocked together by the high-speed cam. The changeover pin is slidably mounted in the high-speed rocker arm. A flat engaging face is formed on a front portion of the changeover pin so as to be engaged with a shaft provided for connecting both of the rocker arms.

9 Claims, 7 Drawing Sheets

VALVE MECHANISM FOR AN INTERNAL COMBUSTION ENGINE

BACKGROUND OF THE INVENTION

The present invention relates to a valve mechanism for an automotive engine and more particularly to the valve mechanism where a valve lift and a valve timing are varied in accordance with engine speed.

In an automotive engine, a valve opening angle which is a cam angle between the valve opening and closing, and the valve lift of the valves have a large influence on volumetric efficiency of the engine, stability of low engine speed and high engine speed performance. Namely, it is preferable to set the valve opening angle and the valve lift at small values respectively in a low and middle engine speed ranges, and to set the opening angle and the lift at a large value in a high engine speed range.

In order to change the valve opening angle and the valve lift, there has been proposed a valve mechanism where a low-speed cam for the low and middle engine speed range, a high-speed ca for the high engine speed range and rocker arms corresponding to the respective cams are provided. One of the rocker arms is operatively connected to the valve and both rocker arms are connected or disconnected from each other in accordance with the engine speed so as to select a necessary cam. Hence the valves are operated to open at a small lift and a small opening degree at a low engine speed and to open at a large lift and a large opening degree at a high engine speed.

U.S. Pat. No. 5,020,488 discloses such a valve mechanism where both rocker arms are mechanically connected. A pair of low-speed cams and a high-speed cam are formed on a cam shaft. A pair of roller followers are rotatably mounted on a connecting shaft provided to connect both the low-speed rocker arms. A part of a peripheral portion of roller follower is projected from the rocker arm to be engaged with the low-speed cam. The high-speed rocker arm has a slipper engaged with the high-speed cam. A changeover pin is slidably mounted in the high-speed rocker arm to be engaged with the connecting shaft so as to connect the high-speed rocker arm with the low-speed rocker arms.

The connecting shaft has an annular groove having a semicircular cross section at the periphery thereof. The radius of the semicircle is set to a larger value than the radius of the changeover pin so that the pin can be smoothly engaged with the groove. However, such a larger diameter causes a point contact between the wall of the groove and the changeover pin. As a result, contact pressure at the contact point increases, which causes wear and tear of the parts.

On the other hand, the changeover pin is formed with a piston and a rod and is slidably mounted in a piston chamber formed in the high speed rocker arm. The pin is projected by oil pressure applied to an oil chamber and retracted by a spring provided in a spring chamber. The rod has a small diameter so as to form the piston and to provide the spring. Consequently, the changeover pin has a low stiffness and low mechinability. The oil chamber and the spring chamber which are separated by a partition make the construction thereof complicated and occupy a large axial space, which makes the high speed rocker arm large.

SUMMARY OF THE INVENTION

An object of the present invention is to provide a valve mechanism in which there is contact pressure between a changeover pin and a shaft, and the changeover pin can be smoothly engaged with the shaft.

Another object is to provide the valve mechanism wherein changeover means can be made small and has high stiffness.

According to the present invention, there is provided a valve mechanism for an internal combustion engine having, at least one intake valve and at least one exhaust valve, a cam shaft having a low-speed cam and a high-speed cam, a low-speed rocker arm operatively connected to one of the valves, a high-speed rocker arm rocked by the high-speed cam, a connecting shaft secured to the low-speed rocker arm and arranged to rock the low-speed rocker arm by the low-speed cam, the changeover pin slidably mounted in the high-speed rocker arm so as to be engaged with the connecting shaft for connecting the low-speed rocker arm and the high-speed rocker arm to each other so as to be rocked together by the high-speed cam.

The mechanism comprises the changeover pin slidably mounted in a bore formed in the high-speed rocker arm and having a flange slidably mounted in an oil chamber formed in the high-speed rocker arm, a return spring provided between the flange and a shoulder formed between the bore and the oil chamber, a flat engaging face formed in a front portion of the changeover pin so as to be engaged with the connecting shaft when the changeover pin is projected by oil supplied to the oil chamber, and means for preventing the changeover pin from rotating about an axis thereof.

In an aspect of the invention, the changeover pin has roundish chamfers formed on front edges of a body portion of the pin and the flat engaging face.

The other objects and features of the present invention will become understood from the following description with reference to the accompanying drawings.

DETAILED DESCRIPTION OF THE PREFERRED EMBODIMENTS

Figure 1:
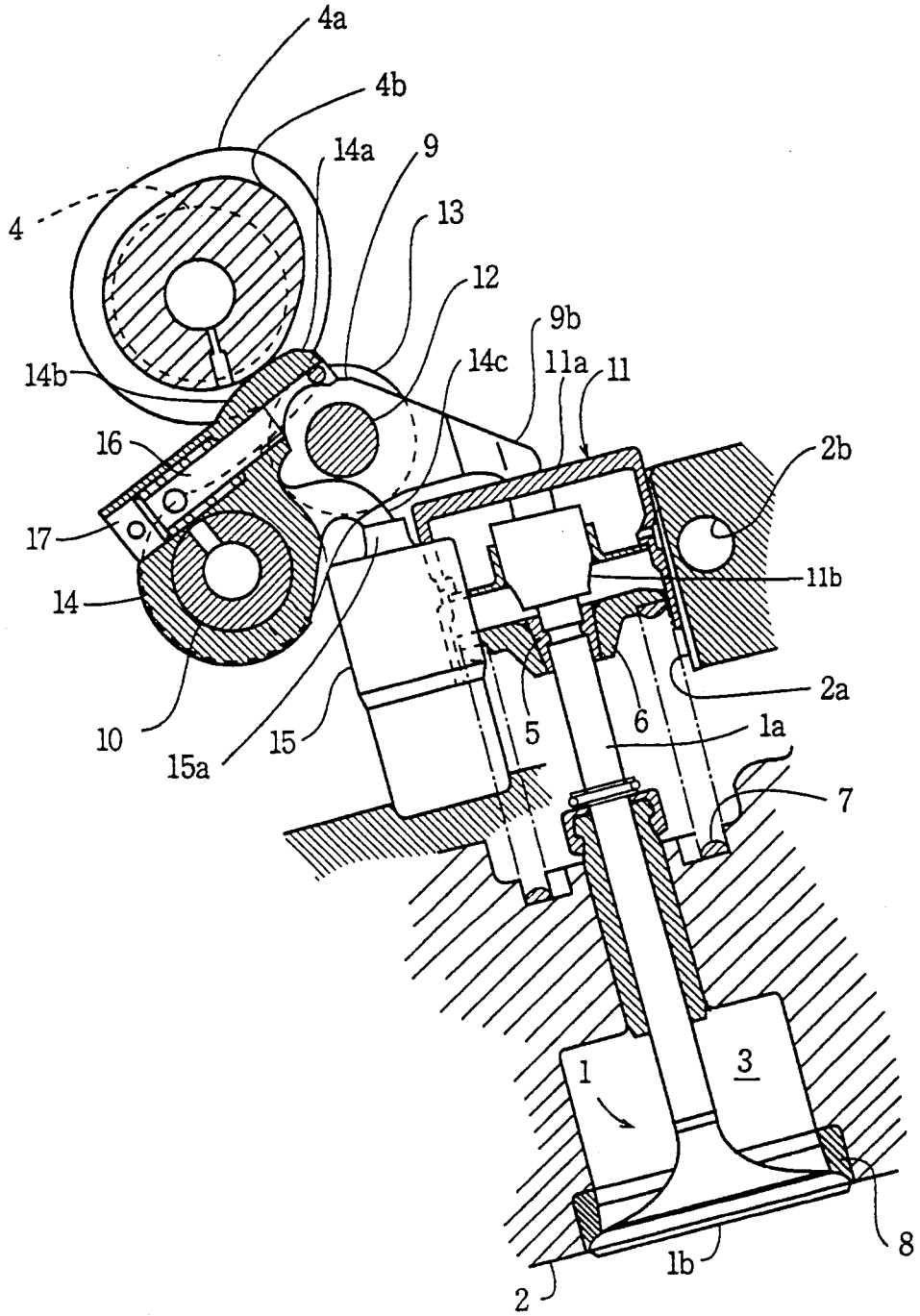
FIG. 1 is a sectional view of a valve mechanism according to the present invention.
Figure 2:
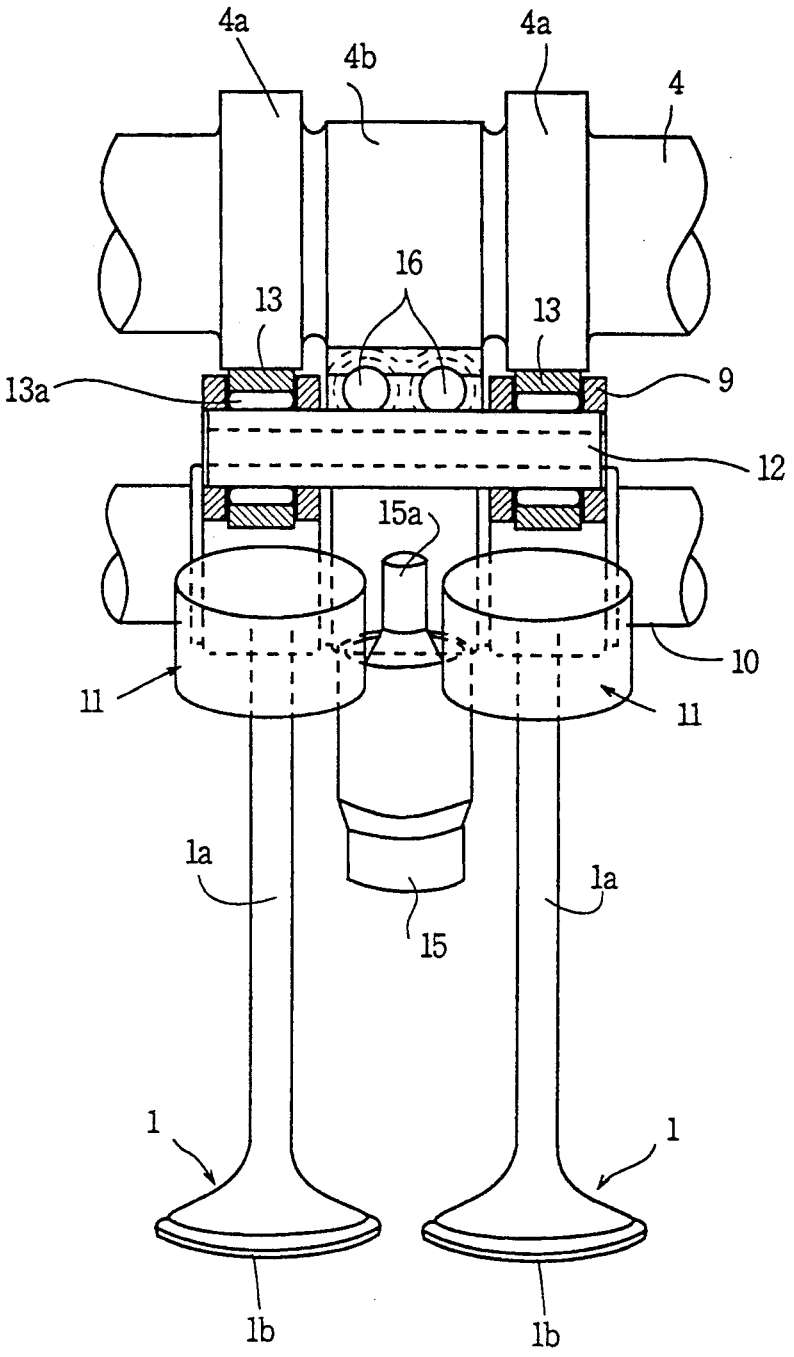
FIG. 2 is a plan view of the valve mechanism.

Referring to FIGS. 1 and 2, an engine to which the present invention is applied has a bifurcated intake port 3 formed in a cylinder head 2, a pair of intake valves 1 each of which is slidably mounted in the cylinder head 2. Each valve has a valve head 1*b* engaging with a valve seat 8 mounted in the intake port 3 and a stem 1*a* to which a retainer 6 is secured through a cotter 5. A valve spring 7 is provided between the retainer 6 and the cylinder head 2 to urge each of the valves 1 to the valve seat 8. A guide hole 2a is formed in the cylinder head 2, in which a bucket type hydraulic lash adjuster 11 is slidably mounted. The hydraulic lash adjuster 11 comprises a bucket 11a slidably mounted in the guide hole 2a, and a cylindrical body 11b slidably mounted in the bucket 11a. Pressurized oil is supplied from an oil passage 2b in the cylinder head 2 to an oil chamber in the body 11b, so that the bucket 11a is pressed against the nose 9b of the rocker arm 9 and the body 11b is pressed against the top of the stem 1a, thereby maintaining clearances between the nose 9b and the body 11b to zero. Since the construction of the hydraulic lash adjuster is well known, the details thereof are not herein described.

A valve mechanism for the intake valves 1 comprises a camshaft 4 and a rocker arm shaft 10 which are parallel to the camshaft 4 and securely mounted on the cylinder head 2. The camshaft 4 is operatively connected to a crankshaft of the engine so as to be rotated at half speed of the crankshaft. Formed on the camshaft 4 are a high-speed cam 4b, and a pair of low-speed cams 4a on opposite sides of the high-speed cam 4b. The high-speed cam 4b is formed with a base circle and a lobe providing a predetermined large lift and a large opening angle for the valve in a high engine speed range. Each of the low-speed cams 4a has a large base circle and a large lobe providing a predetermined small lift and a small opening angle of the valves in a low engine speed range.

Figure 3:
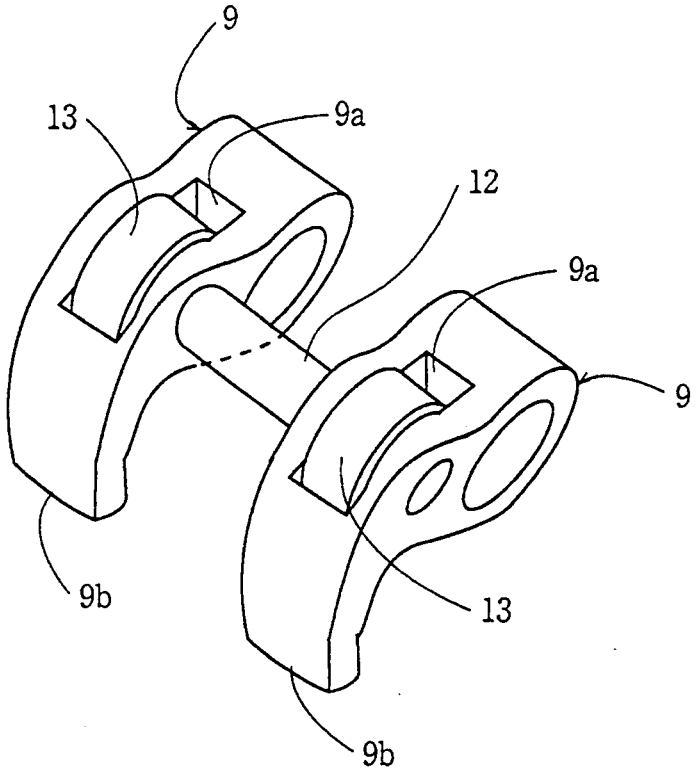
FIG. 3 is a perspective view showing low speed rocker arms.

Pivotally mounted on the rocker arm shaft 10 is a pair of low-speed rocker arms 9 at the respective end thereof, corresponding to the low-speed cams 4a. A high-speed rocker arm 14 is pivotally mounted on the rocker arm shaft 10 between the low-speed rocker arms 9, corresponding to the high-speed cam 4b. A nose 9b at an end of each low-speed rocker arm 9 engages with the valve stem 1a through the lash adjuster 11. In an intermediate position of the low-speed rocker arm 9, a hole 9a is formed (FIG. 3). Roller followers 13 are rotatably mounted on a connecting shaft 12 through a needle bearing 13a and disposed in respective holes 9a. The shaft 12 is provided through the rocker arms 9 and secured thereto. A part of the peripheral portion of each roller follower 13 upwardly protrudes out of the hole 9a so as to abut against the corresponding low-speed cam 4a.

The high-speed rocker arm 14 has a bifurcate having two ends so as not to interfere with the shaft 12. An upper free end 14a of the arm 14 forms a slipper 14b thereon which engages with the high-speed cam 4b. A lower free end 14c engages with a plunger 15a of spring means 15 so that the slipper 14b is constantly pressed against the high-speed cam 4b.

A pair of changeover devices are provided in parallel in the high-speed rocker arm 14.

Figure 5:
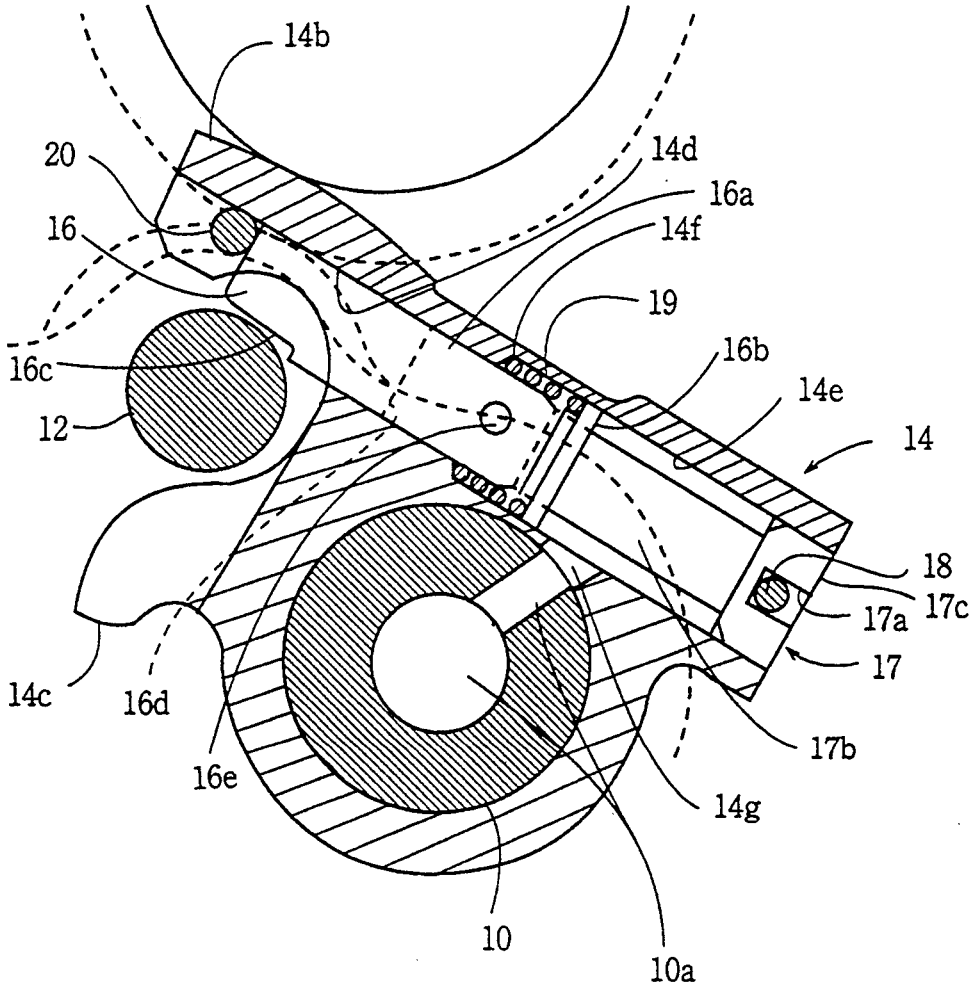
FIG. 5 is an enlarged sectional view of a high speed rocker arm.

Referring to FIG. 5, each changeover device has a bore 14d formed in an upper portion of the high-speed rocker arm 14, located above the shaft 12 perpendicular to the axis of the shaft 12. An oil chamber 14e having a larger diameter than the bore 14d is formed in the arm coaxially with the bore through a shoulder 14f. A changeover pin 16 is slidably mounted in the bore 14d.

An underside portion of the bore 14d is opened at a front end portion, so that a front portion of the pin 16 is exposed.

Figure 4A:
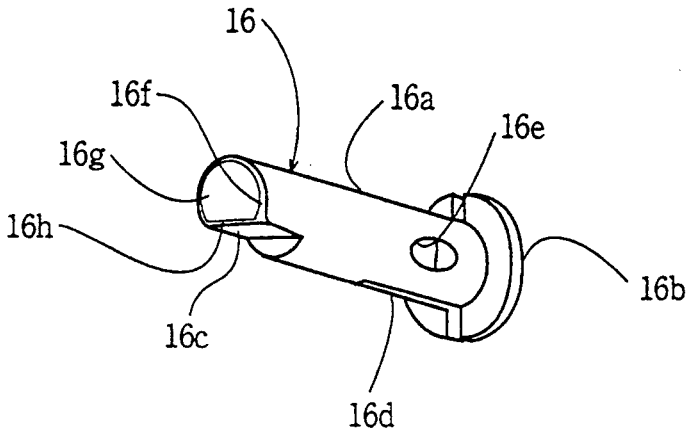
FIG. 4*a* is a perspective view of a changeover pin.

As shown in FIG. 4a, the changeover pin 16 has a body 16a perpendicular to the axis of the shaft 12, a flange 16b at the rear end of the body 16a, and a flat engaging face 16c formed in a front end portion of the body. The engaging face 16c is parallel to the axis of the body 16a and to the axis of the shaft 12 so as to engage with the shaft in a line contact. A slit 16d is formed in the pin 16 along the axis thereof, and a hole 16e is formed to be communicated with the slit 16a. The edge between the body 16a and an end face 16g is roundly chamfered to form a roundish chamfer 16f. The edge between the end face 16g and the engaging face 16c is also roundly chamfered to form a roundish chamfer 16h. Both chamfers 16f and 16h are smoothly joined.

Figure 4B:
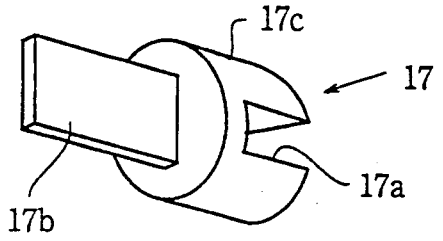
FIG. 4*b* is a perspective view of a guide plate.

As shown in FIG. 4b, a guide member 17 has a guide plate 17b, a plug 17c, and a slit 17a radially formed in the plug 17c. The guide member 17 is mounted in the oil chamber 14e and the plug 17c is watertightly secured to the arm 14 to define the oil chamber 14e. The guide plate 17b is slidably engaged with the slit 16d of the pin 16, thereby preventing the pin from rotating about the axis thereof. A pin 18 secured to the rocker arm 14 in a radial direction is engaged with the slit 17a to prevent the guide member 17 from removing from the rocker arm 14. A spring 19 is disposed between the shoulder 14f and the flange 16b to urge the pin 16 at a retracted position where the flange 16b abuts on the plug 17c.

The oil chamber 14e is communicated with an oil gallery 10a formed in the rocker arm shaft 10 through an oil passage 14g formed in the rocker arm 14 as shown in FIG. 5. The oil gallery 10a is communicated with an oil pump (not shown) through a changeover valve. When engine speed exceeds a predetermined high speed, for example 5,000 rpm, oil is supplied to the oil chamber 14e by operating the changeover valve, thereby projecting the pin 16. The pin 16 is stopped by a stopper 20 secured to the arm 14. When the engine speed reduces below the predetermined speed, the oil in the oil chamber is drained. Thus the pin 16 is retracted by the spring 19.

When the base circle of the high-speed cam 4b contacts the slipper 14b of the high-speed rocker arm 14, the space between the shaft 12 and the inside wall of the bore 14d in the high-speed rocker arm 14 becomes maximum. At that time, the oil is supplied to the oil chamber 14e, so that the pin 16 is pushed toward the shaft 12 and inserted in the space between the shaft 12 and the bore 14b. Thus, the rocker arm 14, the shaft 12 and the low-speed rocker arms 9 are combined with each other. While the rocker arms 9, 14 are thus connected, the roller followers 13 are disengaged from the low-speed cams 4a except the base circle portion.

The operation of valve mechanism is described hereinafter.

When the engine speed is lower than a reference speed, for example 5,000 rpm, the changeover valve operates to drain the oil from the oil chamber 14e in each of the changeover devices. Thus, the spring 19 urges the changeover pin 16 to retract inside the high-speed rocker arm 14 as shown in FIG. 1. Thus, the low-speed rocker arms 9 and the high-speed rocker arm 14 are disconnected from each other. Hence the low-speed rocker arms 9 contacts the low-speed cams 4a, so that each valve 1 opens at a small lift and small valve opening angle, thereby providing stable combustion and hence stable engine torque. Since the roller followers 13 contact the cams 4a, the friction therebetween is small. Meanwhile the high-speed rocker arm 14 urged by the spring means 15 to the high-speed cam 4b is idly rocked.

When the high-speed rocker arm 14 contacts the base circle portion of the cam 4b, the low-speed rocker arms 9 also abut on the base circles of the low-speed cams 4*a*. Consequently, the rocker arms 14 and 9 are positioned at upper positions to form a large space between the rocker arm shaft 12 and the rocker arm 14. Thus, it is possible for the pin 16 to be projected into the space.

Figure 6:
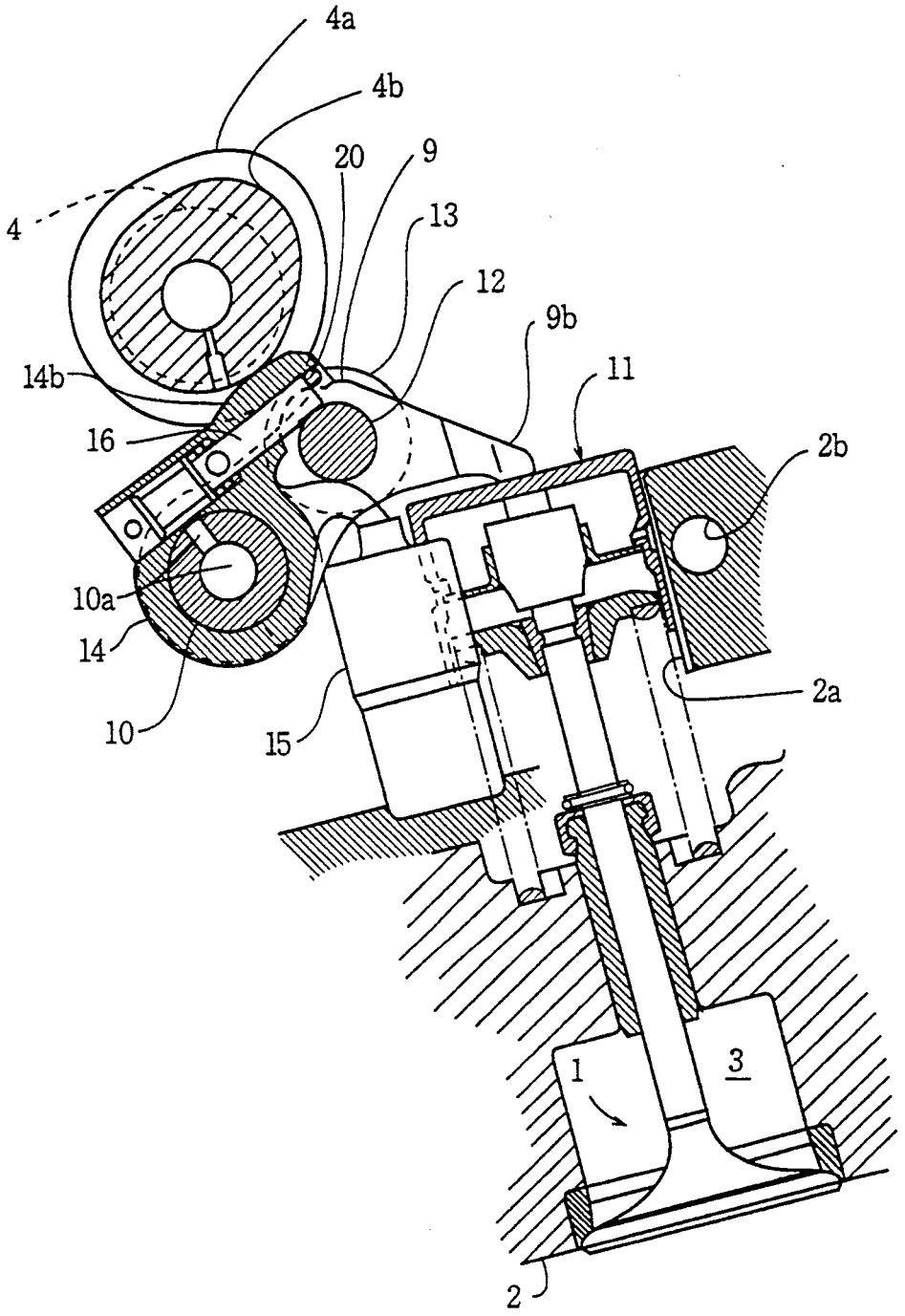
FIG. 6 is a sectional view explaining an operation of the valve mechanism in a high engine speed range.

When the engine speed exceeds 5,000 rpm, the changeover valve is operated to supply the oil to the oil chamber 14*e*. Thus, the changeover pin 16 is pushed by the pressurized oil and inserted between the upper inside wall of the rocker arm 14 and the shaft 12 as shown in FIGS. 5 and 6 when the rocker arms 14 contact the base circle portion. Consequently, high-speed rocker arm 14 is connected with the low-speed rocker arms 9 through the pin 16 and the shaft 12. When the rocker arm 14 contacts the lobe of the high-speed cam 4*b*, the roller followers 13 do not engage with the lobes of the low-speed cams 4*a*. Thus, the valves 1 are opened at a large lift and a large opening angle.

Since the hydraulic lash adjuster 11 is disposed between the rocker arms 9 and the valve stems 1*a*, valve clearance is eliminated, thereby reducing noises caused by the clearances. The changeover pin 16 engages with the connecting shaft 12 at the flat engaging face 16*c* in the line contact. Therefore, the contact pressure therebetween is largely reduced, thereby decreasing the wear and tear of the parts.

The edge of the body 16*a* of the changeover pin 16 is formed with the roundish chamfer 16*f*, and the edge of the engaging face 16*c* is also formed with the roundish chamfer 16*h*, and the corners between the chamfers 16*f* and 16*h* are also rounded. Therefore, if the connecting pin 16 is somewhat angularly displaced about the axis thereof, the engaging face 16*c* can be smoothly engaged with the shaft 12 without striking the shaft 12.

Figure 7:
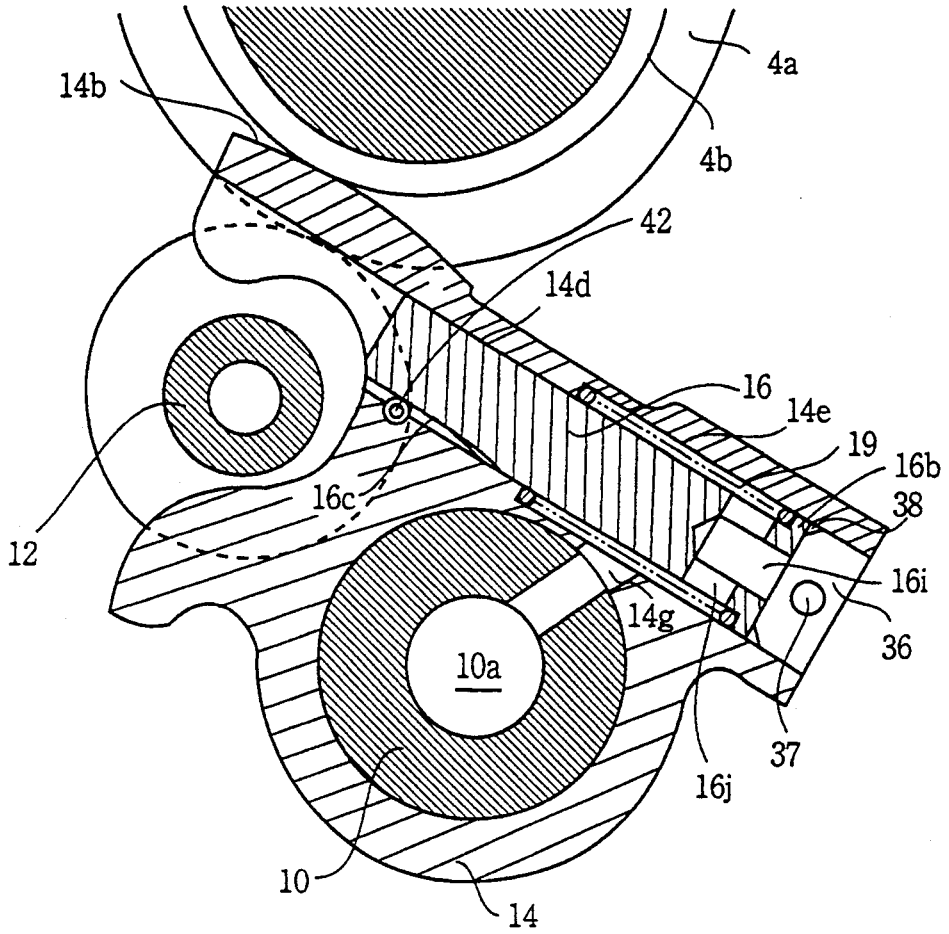
FIG. 7 is a sectional view of a second embodiment of the valve mechanism.
Figure 8:
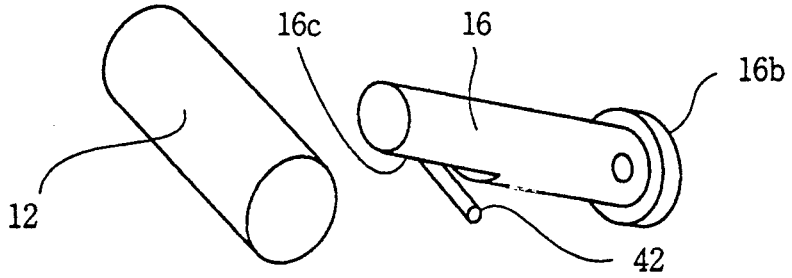
FIG. 8 is a perspective view showing a changeover pin of the valve mechanism of FIG. 7.

Referring to FIG. 7 showing the second embodiment of the present invention, the same parts as the first embodiment are identified with the same reference numerals as the first embodiment. Below the engaging face 16*c*, a stopper pin 42 is secured to the high-speed rocker arm 14 in parallel with the face 16*c* and in a perpendicular direction to the axis of the changeover pin 16, so that the angular displacement of the changeover pin 16 about the axis is prevented. The stopper pin 42 serves also as a stopper for restricting the forward movement of the pin 16. Therefore, the guide member 17 in the first embodiment is omitted. A plug 36 is secured to the rocker arm 14 with a pin 37.

The changeover pin 16 has an axial hole 16*i* opened to an end oil chamber 38 behind the flange 16*b*, and a radial hole 16*j* communicating the oil chamber 14*e* with the axial hole 16*i*. Thus, the oil is supplied to the end oil chamber 38 through the gallery 10*a*, an oil passage 14*g*, an oil chamber 14*e*, and the holes 16*j* and 16*i*.

Other structures and operations are the same as the first embodiment.

In accordance with the second embodiment, the stopper pin 42 serves as a stopper for preventing the angular displacement of the pin 16 about the axis and also for stopping the axial movement of the pin 16. Consequently, the number of the parts is reduced, and hence the structure of the changeover mechanism becomes simple.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A valve mechanism for an internal combustion engine having at least one intake valve and at least one exhaust valve, a cam shaft with a low-speed cam and a high-speed cam, a low-speed rocker arm operatively connected to one of said valves, a high-speed rocker arm rocked by the high-speed cam, a connecting shaft secured to said low-speed rocker arm and arranged to rock the low-speed rocker arm by said low-speed cam, and a changeover pin slidably mounted in an oil chamber formed in said high-speed rocker arm, an improvement of the mechanism comprising:

a flat engaging face formed in a front portion of said changeover pin so as to be engaged with said connecting shaft when the changeover pin is projected by oil supplied to said oil chamber; and means for preventing said changeover pin from rotating about an axis thereof.

2. The valve mechanism according to claim 1, wherein said changeover pin has roundish chamfers formed on front edges of a body portion of the pin and said flat engaging face.

3. The valve mechanism according to claim 1, wherein said means is a guide plate secured to said high-speed rocker arm so as to be engaged with an axial slit formed in the changeover pin.

4. The valve mechanism according to claim 1, wherein said means is a stopper pin secured to said high-speed rocker arm to be engaged with said flat engaging face.

5. The valve mechanism according to claim 1, further comprising:

a hydraulic lash adjuster disposed between said low-speed rocker arm and a stem of said one valve; and said lash adjuster comprises a bucket slidably mounted in a guide hole formed in a cylinder head of said engine and provided to be engaged with said low-speed rocker arm.

6. A valve mechanism for an internal combustion engine having, at least one intake valve and at least one exhaust valve, a cam shaft with a low-speed cam and a high-speed cam, a low-speed rocker arm operatively connected to one of said valves a high-speed rocker arm rocked by the high-speed cam, a connecting shaft secured to said low-speed rocker arm and arranged to rock the low-speed rocker arm by said low-speed cam, a changeover pin slidably mounted in said high-speed rocker arm, an improvement of the mechanism comprising:

said changeover pin is slidably mounted in a bore formed in said high-speed rocker arm and having a flange slidably mounted in an oil chamber formed in said high-speed rocker arm;

a return spring provided between said flange and a shoulder formed between said bore and said oil chamber;

a flat engaging face formed in a front portion of said changeover pin so as to be engaged with said connecting shaft when the changeover pin is projected; and means for preventing said changeover pin from rotating about an axis thereof.

7. The valve mechanism according to claim 6, wherein said changeover pin has an axial hole opened to an end oil chamber behind said flange and a radial hole communicating said oil chamber with the axial hole, so that said oil is supplied from the oil chamber to the end oil chamber through the radial hole and the axial hole.

8. The valve mechanism according to claim 6, wherein said low-speed rocker arm comprises two sets of rocker arms connected by said connecting shaft provided for operating two valves, and said high-speed rocker arm is disposed between the low-speed rocker arm.

9. The valve mechanism according to claim 5, further comprising:

a hydraulic lash adjuster disposed between said low-speed rocker arm and a stem of said one valve; and said lash adjuster comprises a bucket slidably mounted in a guide hole formed in a cylinder head of said engine and provided to be engaged with said low-speed rocker arm.

* * * * *